United States Patent [19]

Williams

[11] Patent Number: 4,545,531

[45] Date of Patent: Oct. 8, 1985

[54] WHEELED SPRAYING DEVICE

[75] Inventor: David A. Williams, Fremont, Calif.

[73] Assignee: Aervoe-Pacific Company, Inc., San Leandro, Calif.

[21] Appl. No.: 514,831

[22] Filed: Jul. 18, 1983

[51] Int. Cl.[4] ..... B05B 1/28; B67D 5/64

[52] U.S. Cl. ..... 239/150; 239/286; 222/164; 222/611; 222/612; 118/305

[58] Field of Search ..... 239/150, 282, 283, 286, 239/287, 172; 222/608–612, 160, 164, 174, 402.15; 118/305, 504; 180/906; 301/128

[56] References Cited

U.S. PATENT DOCUMENTS

| | | | |
|---|---|---|---|
| 3,352,283 | 11/1967 | Maus | 118/305 |
| 3,687,371 | 8/1972 | Swager | 239/150 |
| 3,700,144 | 10/1972 | Smrt | 239/286 X |
| 4,053,108 | 10/1977 | Hofmann | 239/150 |
| 4,262,821 | 4/1981 | Smrt | 239/172 X |

*Primary Examiner*—Andres Kashnikow
*Assistant Examiner*—James R. Moon, Jr.
*Attorney, Agent, or Firm*—Claude A. S. Hamrick

[57] ABSTRACT

A versatile manually operated striping device has a wheeled base and a handle for pushing the base. The base is in a block Y configuration which provide a U-shaped front end. The front wheels are mounted on separate axles that are extra long. A disk shaped mask is attached to the inboard side of each axle. For normal striping, a can tower is mounted on a moveable mounting bracket that is positioned so that the center of the bottom of the can tower is centrally located in said U-shaped front end. An aerosol spray can inserted in the can tower then sprays, the paint between the legs of the U to provide the normal working, when an actuator is activated. The moveable mounting bracket can be relocated to permit spraying behind the central transverse portion of the base or to the side. The mounting bracket includes a pluralty of holes in a vertical line that fit mounting studs that are attached to one side and to the rear of the can tower. The height of can tower, and then the height of the aerosol spray can is a measure of the spray width. Calibration marks may be located adjacent the holes to denote spray width. The disk masks may be positioned to provide a clean edge by adjusting the position of the axles, and should be coordinated with the spray height to obtain the best results.

11 Claims, 5 Drawing Figures

WHEELED SPRAYING DEVICE

BACKGROUND OF THE INVENTION

1. Field of the Invention

This invention relates to a spraying device, and more particularly to a striping and marking device in which the width of the stripe may be preadjusted; and in which the marks may be linear as when they are applied to the side and top surface of items such as curbs, or the marks may be circular or arcuate patterns as when they are used to mark out activity areas on playgrounds, athletic fields and the like.

2. Description of the Prior Art

A wheeled spraying apparatus is illustrated in U.S. Pat. No. 3,700,144, issued Oct. 24, 1972 to Thomas J. Smrt and includes a box-like frame supported by a pair of forward and a pair of aft wheels, the wheels of each pair being positioned one on each side of the frame and applied for connection to the frame by means of axles through the frame. The wheels positioned on the same side of the frame are substantially in line. The wheels provide forward and aft rectilinear motion, but because of fixed mounting do not permit arcuate or circular patterns to be formed. Thus, the device is confined to striping situations such as may be required in striping parking places in parking lots, or athletic fields where only linear striping is necessary. The frame includes a base plate which is provided with an opening to receive the valve end of an inverted aerosol spray can, and side plates extend from the base plate to maintain the can in a substantially upright position. There is an upwardly extending handle for pushing the frame over the surface to be marked. A cable extends along the handle between a valve crank mounted on the frame and a trigger mounted on the upper end of the handle. The spray can valve is actuated by a slide plate which is slidably secured to the base plate, and sliding movement of the slide plate is effected by the valve crank when the trigger is actuated. No provision is made for adjusting the height of the aerosol spray can nor its angular relationship with respect to the base. Thus the width of the stripe is not readily controllable nor is it possible to position the can to permit the spraying of the sides or tops of curbs.

A marking apparatus is disclosed in U.S. Pat. No. 4,262,821 issued Apr. 21, 1981 to Thomas J. Smrt. As shown by the patent, the marking apparatus includes a wheel equipped base with wheels positioned on the base as shown in U.S. Pat. No. 3,700,144 thereby providing only rectilinear motion. The can holder is adjustably mounted on the handle for holding a can of marking material. The can holder includes a stop plate which engages the actuator of the spray can and through which the marking material is sprayed. A trigger rod is moveably mounted on the handle for pushing the can toward the stop plate for opening the valve of the can and releasing the spray generally downwardly to the surface to be marked. While the height of the can may be adjusted, which provides a measure of control of the stripe width, no provision has been made for paint masks which may be positioned to control the stripe and provide a more sharply defined edge to the stripe. Surely no provision has been made for adjusting the direction of the paint spray to permit curb spraying along the sides or top. Nor is any provision made for positioning the spray can so as to allow spraying alongside of the device to reach those areas that would otherwise be inexcessable because of the proximity of curbs or other obstructions.

SUMMARY OF THE PRESENT INVENTION

It is an object of the invention to control stripe width by adjustment of the height of the spray nozzle of an aerosol spray can above the surface to be striped or marked.

It is another object of the invention to further define the stripe width and provide sharper stripe edges.

It is still another object of the invention to allow adjustment of the angle at which the spray is discharged relevant to the surface on which the device rests.

It is yet another object of the invention to allow the spray can to be mounted in a position so as to permit marking adjacent to obstructions.

It is yet a further object of the invention to have wheels attached at least one of which can be set to cause the device to move in an arcuate or circular manner.

Briefly, a marking apparatus adapted for use with an aerosol spray can containing marking material comprises a wheeled base for providing a moveable mounting surface, said base including support means for holding said aerosol spray can in an operable position, said support means including positioning means for setting the stripe width, marking angle and the relationship of the stripe path with respect to the wheeled base and an actuator for selectively controlling the expulsion of material from said aerosol can.

IN THE DRAWINGS

DETAILED DESCRIPTION OF THE PREFERRED EMBODIMENTS

Figures 1, 2, 3, 4, 5:
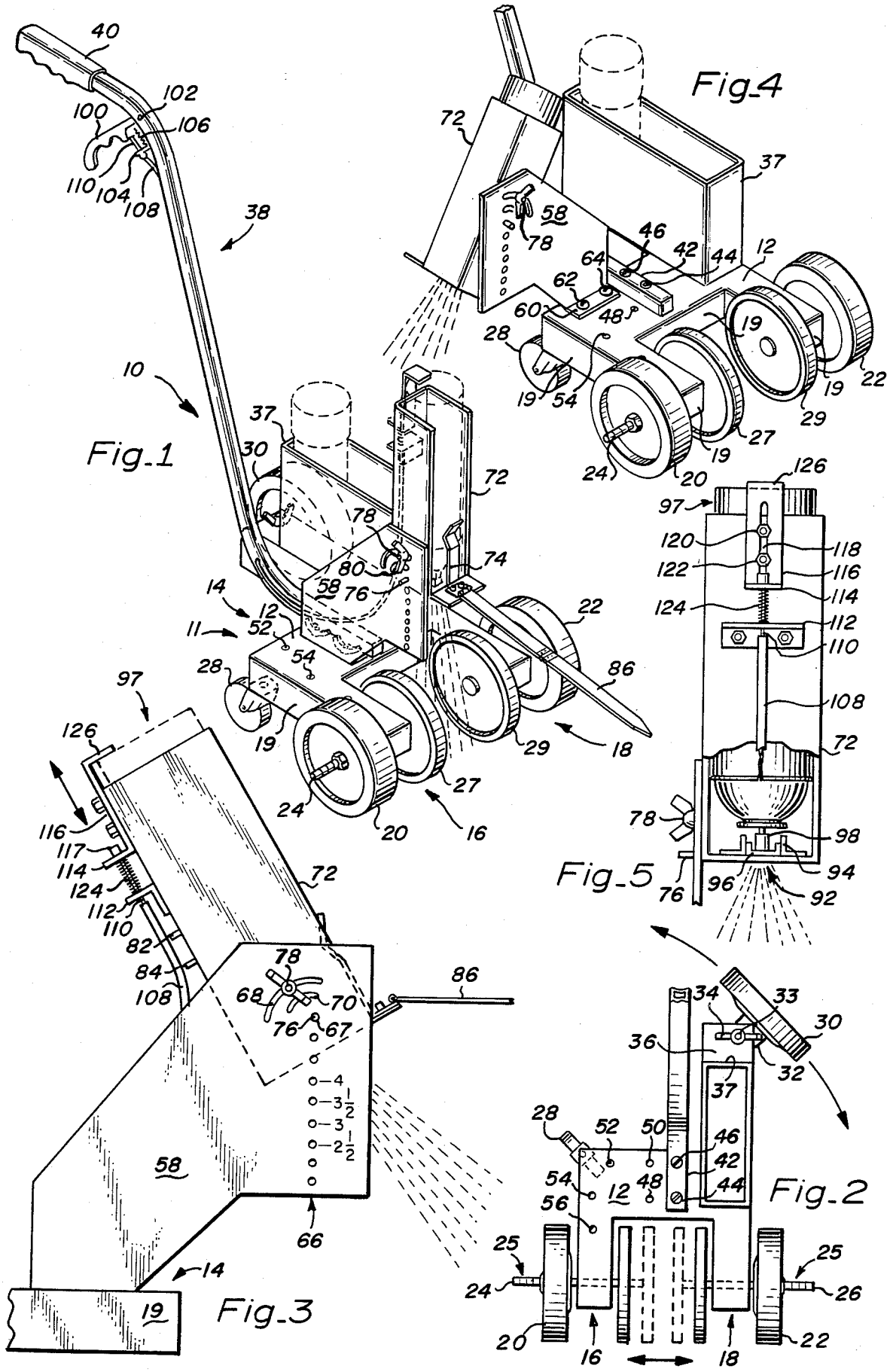
FIG. 1 is a perspective view of the wheeled spraying device of the invention.
FIG. 2 is a partially broken top view of the wheeled spraying device of this invention.
FIG. 3 is a partially broken elevation view of the right side of the central transverse portion (14) of the base structure and illustrates a portion of the peripheral side (19) and shows in detail the moveable can tower mounting bracket (58) and active spray can holder (72)
FIG. 4 is a partially broken perspective view similar to that shown in FIG. 1 but illustrates one way in which the mounting bracket (58) may be positioned on the upper surface of base (12) for curb marking.
FIG. 5 is a partially broken view of the active spray can holder (72) and illustrates the aerosol can mounted in the head adapter alignment clips (94) and the rectangular valve spray adapter (96) and the actuator mechanism for causing the spray valve (98) to be open to expell the spray material for striping purposes.

By referring to FIGS. 1 and 2 along with the following description, a number of the features of applicants invention may be understood. A marking device 10 is comprised of a base portion 11 having an upper surface 12 that is shaped in a generally block Y configuration and consists of a central transverse portion 14 to which is formed, on the forward portion thereof, a first rectangular shaped arm 16 and a second rectangular shaped arm 18. Downwardly extending sides 19 of base 11 are formed about the periphery except for the portion adjacent the adjusting wheel 30 as will be disclosed in more detail later. Front wheels 20 and 22 are separately journaled on their respective axles 24 and 26 with axle 24 journaled in the base extending sides of arm 16; and the axle 26 being journaled in the base extending sides of arm 18.

Referring to FIG. 2 it may be seen that axles 24 and 26 are longer than is necessary to support the wheels 20 and 22 respectively. This excess length is used for setting the stripe width masks. The calibration marks 25 permit pre-adjustment of the stripe width. While not shown on the drawing the actual spacing width associated with each calibration mark may be engraved on the axle adjacent its respective calibration mark. Disk shaped spray masks 27 and 29 are adapted to be attached to the inboard end of each of the respective axles 24 and 26. The stripe width masking effect is then set by moving the axles 24 and 26 axially so as to position the calibration mark adjacent the outboard edge of the wheel associated therewith. As will be described in more detail hereinafter, the positioning of the disk shaped masks should be set in accordance with the spray width selected, by the adjustment of the spray can height.

Two other wheels are in employed. The first is a caster wheel 28 which is attached on the rear right portion of central transverse portion 14. Caster wheel 28 provides the function of support to maintain stability of the device. More importantly, the wheel 28 cooperates with circular adjusting wheel 30 to permit arcuate, circular or rectilinear motion of the base. While most wheeled spraying devices are arranged so that they may only provide rectilinear motion, and thus are unable to mark arcs or circular patterns, the present invention includes circular adjusting wheel 30 which is releaseably attached to base portion 36 at the distal end thereof as shown in FIG. 2.

A mounting bracket 32 to which wheel 30 is rotatably attached includes a mounting stud 33 which passes through an aperture (not shown) but which is near the distal end of base portion 36. A wing nut or other similar securing device is then releasably attached to the mounting stud 33 whereby the wheel 30 is releaseably attached to the base portion 36. In order that wheel 30 may be turned, the downwardly extending sides 19 terminate at a point forward of the arc swung by the mounting bracket 32. Also because wheel 30 may be positioned where it is nearly at right angles to wheel 22 there is no peripheral downward extension at the rear portion of arm 36. Thus, wheel 30 may be set to provide angled motion and the setting may be calibrated to define the desired radius of arc.

It is to be noted that a spare can holder 37 is attached to the upper base surface 12. It is positioned so that a portion of the spare can holder 37 extends along the rearward rectangularly shaped arm 36 adjacent the circular adjusting wheel 13 and extends into the central transverse portion 14 of said base portion 11. As shown in FIG. 1 there is a spare can in phantom in the spare can holder 37. It should be understood that spare can holder 37 would hold a plurality of cans thus effecting a saving in time which might be required to obtain additional spray paint.

Also attached to the base portion 11 is an upwardly extending handle 38 which has a hand grip 40 an apertured lower handle part 42 arranged for attachment to the upper surface of the base 12 by mounting bolts 44 and 46 the handle is curved to provide a separation between the operator and the base of the spray marking device, and is also at a convenient height. The handle also provides a mounting locator for the spray actuator and this will be disclosed in more detail later.

In addition to the mounting holes which are used to attach handle 38, there are five additional mounting holes 48, 50, 52, 54, and 56 which provide three useful mounting positions for the moveable mounting bracket 58. In FIG. 1, the mounting bracket 58 is shown mounted in the mounting holes 48 and 50 and is secured by bolts and wing nuts the later being shown in phantom. The position of the mounting bracket as shown in FIG. 1 is in the normal striping position where the aerosol spray can is mounted upside down in an active spray can tower or holder 72 and held in position by spring clip 74 so that the spray, when the spray valve is actuated is downward as shown by the dashed lines. The spray material then passes between the disk masks 27 and 29 to the surface to be marked. A retractable guide arm 32 is provided and is especially useful for making long straight lines. It is in the direct line of vision of the operator which allows the operator to conveniently guide the device along a pattern such as may be defined by a chalk line.

Referring to FIG. 4 the removable mounting bracket 58 is shown mounted in apertures 50 and 52 by means of bolts 62 and 64 and it is seen that the spray is expelled at substantially a right angle with respect to the direction of motion of the spraying device. Further the active spray can holder 72 is inclined with respect to the vertical which places it in a position so that it may be used for curb marking or for special marking purposes.

The manner by which stripe width and the angle of discharge of the spray material is controlled may be understood from the following discussion. The removable mounting bracket 58 is used not only to position the active spray can holder 72 at the location required for the particular striping or marking activity but it also includes a plurality of vertically spaced holes 66 through which a guide pin 76 and mounting bolt 78, which are vertically aligned on one side of can holder 72, may be inserted and secured thereto. For normal striping purposes the heighth of the spray can above the surface to be marked is directly related to the stripe width and calibration marks such as shown in FIG. 3 may be associated with the vertically spaced, in line holes 66. As was shown in FIG. 4 the can holder 72 was displaced at an angle with respect to the vertical and this is accomplished by means of arcuate slots 68 and 70, whereby the guide pin 76 is inserted in the top vertical, in line hole 67 and the mounting stud 78 is in the top most arcuate slot 68. A releaseable securing device such as a wing nut 80 may be tightened down on the mounting stud 78 in order to lock can holder 72 at the desired angle. It should be noted that a pair of mounting studs 82 and 84 are provided at the rear of can holder 72 and these are preferably used when the can holder is to be aligned at an angle because locking wing nuts such as 80 may then be used to secure both studs firmly to mounting bracket 58.

At the base of can holder 72 is an aperture centrally located therein through which the spray material passes. The spray can 97 is installed upside down with the valve at the bottom. The aerosol can includes a conventional valve which is opened when the valve stem 98 is pushed inward. A rectangular valve spray adapter is attached to the valve 98 and is positioned on the valve so to align the spray pattern. To insure that the spray pattern is correct, head adapter alignment clips 96 are positioned at the bottom of can holder 72. Alignment of the adapter with clips 96 insures that the stem is properly mounted in the can holder 72 prior to operation.

In operation, the operator grips handle 40 and pushes the marking device along in the direction to which the striping or marking is to be obtained. When it is desired to expel spray, i.e., to begin the the striping or marking process, trigger 100 is pulled which trigger is pivoted about pivot pin 102. By pulling the trigger, an actuating wire 110 is pulled upward. This wire 110 passes through cable guide and stop 104 and cable 108 thence through the handle where it exits near the base above the apertured lower handle part 42. Referring to FIGS. 1, 3, and 5 the details of the actuator may be understood. The cable 108, including the actuating wire 104 which slides within the cable 108, has its lower end adjacent thrust plate 112 which is located at the rear and near the upper middle portion of can holder 72. A generally Z-shaped actuator 116 has a lower outward horizontal extension 114 which includes an aperture therethrough. Actuating wire 110 passes through said aperture and is attached to an end stop 117 which holds the end of actuating wire 110 in position. A bias spring 124 is positioned between the upper surface of thrust plate 112 and the lower surface of the horizontal extension 114 of actuator 116. This holds the actuator 116 in its upper most or released position. As more clearly shown in FIG. 5, actuator 116 includes a guide slot 118 through which a pair of guide members 120 and 122 extend and slideably hold actuator 116 in position. Thus, vertical movement of actuator 116, with respect to the guide slot, is possible. At the upper end of actuator 116 is an upper horizontal extension that extends inwardly so that the bottom of the upper horizontal extension is in contact with the bottom of the spray can 97, when the spray can is installed in the can holder 72. This is shown more clearly in FIG. 3. When spray is to be expelled, trigger 100 is pulled against bias spring 106. This moves said trigger about pivot point 102 so that wire 110 is pulled upward. This upward movement at the upper end of handle 38 provides a downward pull of the wire 110 which passes up through the aperture in thrust plate 112, thence through the aperture of the lower horizontal extension 114. This causes actuator 116 to be pulled downward against the bias spring 124 which, in turn, causes the can 96 to be moved downwardly. The axial valve 98 is opened because of this downward movement of the spray can 97 and the spray material is expelled through aperture 92 to the surface to be striped or marked.

Although the present invention has been described herein in terms of a presently perferred embodiment, it will be appreciated by those skilled in the art that alterations and modifications thereof may readily be made to suit particular needs and applications. It is therefore intended that the following claims be interpreted as covering all such alterations and modifications as fall within the true spirit and scope of the invention.

What is claimed is:

1. A marking apparatus adapted for use with an aerosol spray can having a valve spray adapter and containing marking material, said apparatus comprising:

(a) wheeled base means for providing a moveable mounting surface and including:

a block Y-shaped upper surface structure formed by a transverse central member, equal-sized first and second rectangularly shaped arms extending forwardly of said transverse central member and interiorly spaced one from the other to form a U-shaped structure with said transverse member, and a third rectangularly shaped arm extending rearwardly of said central transverse member;

downwardly extending sides formed about the peripheral portions of said Y-shaped structure, except for the distal end of said third arm and a portion of the outboard side adjacent thereto;

axially aligned apertures in said downwardly extending sides of said first and second arms;

first and second axles extending through said axially aligned apertures in said first and second arms; and first and second wheels mounted, respectively, on said first and second axles so as to be positioned on the outboard side of said first and second members, whereby the U-shaped space between the inboard sides of said first and second members is substantially preserved;

(b) means for supporting said paint can in an operable position on said wheeled base means, and including:

can holding means having a head adaptor for alignment of said can valve spray adapter in said can holding means; and a moveable mounting bracket including means to mount said bracket in predetermined locations on said upper surface of said base, and further including a portion extending upwardly from said base and having positioning means adapted to accept said can holding means so that the can height above the surface to be marked and the angular relationship thereto may be adjusted, whereby the spray width angle of discharge may be preselected;

(c) drive means for applying a moving force to said wheeled base means;

(d) positioning means for setting the stripe width, marking angle and relationship of stripe path with respect to said wheeled based means; and (e) means for selectively controlling the expulsion of material from said can.

2. The apparatus of claim 1 wherein said Y-shaped upper surface comprises;

a first pair of longitudinally spaced apertures centered on said transverse central member for mounting said drive means;

a second pair of longitudinally spaced apertures in parallel, but transversely spaced from said first pair, for attaching said moveable mounting bracket so as to permit alignment of said can holder centrally with the center of said U-shaped space between said first and second arms;

a third pair of longitudinally spaced apertures in parallel with, but located outboard of said first and second pair so as to permit locating said moveable mounting bracket in such a position so as to permit the spray to be in line with and to the rear of said first wheel, whereby a marking stripe may be laid down adjacent to a curb or similar obstruction; and a fourth pair of apertures positioned at right angles to said first second and third pairs and situated so that when attached thereto said moveable mounting bracket extends over one end of said transverse central member.

3. The apparatus as set forth in claim 2 wherein said moveable mounting bracket comprises;

a can tower including a mounting bracket having a pair of apertures sized and spaced to align with said second, third and fourth pairs of apertures and adapted to the attached in any one of said mounting positions by a pair of removeable bolts and nuts;

an upwardly extending member formed with and in a plane that is at right angles to said mounting bracket;

a plurality of holes in said upwardly extending member, said holes spaced so as to be in a vertical line when said mounting means is attached to said upper surface, the position of the holes being selected so as to permit preselection of the width of the stripe to be marked; and a pair of arcuate guides located above the top most hole and each having one end thereof in substantial alignment with said vertically aligned holes and the other end rearward thereof, said arcuate guides permitting selection of the spray angle with respect to the horizontal.

4. The apparatus in claim 3 wherein said can holding means further includes; a box like structure adapted to hold a single spray can, having open front and top surfaces and having said head adapter mounted on and aligned with a spray aperture in said bottom surface;

a mounting guide pin and a mounting bolt formed in a vertical line along one side for attachment to said moveable mounting means;

a pair of vertically aligned mounting bolts in the rear portion of said box like structure for providing an alternate attachment means to said moveable mounting means; and can pressure means for forcing the can downward against said head adapter to expel the material from said can through said spray aperture and on to the surface to be marked.

5. The apparatus of claim of 4 wherein said can pressure means comprises; a thrust plate transversely mounted on the rear of said can holder below the top surface thereof;

an actuator arm slidably mounted above said thrust plate said actuator arm being substantially Z-shaped and having a horizontal outward extension at the lower end adjacent said thrust plate and a horizontal inward extension at the upper end which is higher than the top of said can holder and which extends into the interior space of the can bottom, said upper end extension being positioned to rest on the bottom surface of said can when the explusion controlling means is in the rest state so as to force the can downward when the expulsion controlling means is actuated so as to expel the spray.

6. The apparatus of claim 5 wherein said wheeled base means further comprises: a third wheel releasably attached to the outboard rear part of said third member, said third wheel being located so that the angle of the direction of rotation may be selected whereby the circular motion of said apparatus may be preselected; and a caster type wheel positioned adjacent the rear one end of said transverse central member to provide horizontal support and to operate in conjunction with said third wheel to facilitate the circular motion when said third wheel is adjusted therefor.

7. The apparatus as set forth in claim 6 wherein said first and second axles are slidably engaged in said respective wheels and mounting apertures and the length of said axles is greater than the width of said first and second arms, said length being selected and the axles marked at calibration points for stripe width indication.

8. The apparatus as set forth in claim 7 including first and second circular spray masks each having a central aperture adapted for engagement with an attachment to the inboard end of said first and second axles, respectively, so as to sharply define the edges of said stripe, the width being set by the positioning of said slidable axle member.

9. The apparatus of claim 8 wherein said drive means comprises a handle having an upwardly and backwardly extending portion, having a pair of apertures sized and spaced to align with said first pair of longitudinally spaced apertures that are centered on said transverse central member; and mounting bolts and nuts for securing said handle to said wheeled base means whereby the motion of said apparatus may be readily controlled.

10. The apparatus of claim 9 wherein said means for selectively controlling comprises;

a trigger means located adjacent the upper end of said handle;

a cable having one end adapted for attachment to said trigger means said cable passing through said handle to a point adjacent said wheeled base, the other end of said cable passing through a hole in said thrust plate and through the lower horizontal extension of said actuator arm and being secured thereto; and spring means supported between the top surface of said thrust plate and the bottom surface of said lower horizontal extension to bias said actuator upward, the trigger action being used to overcome said bias and force the can downward, whereby the material will be expelled from said can.

11. The apparatus as set forth in claim 10 wherein said wheeled base means further comprises a spare can holder mounted on the top surface of said third arm and a portion of said transverse member.

* * * * *